US012467224B2

(12) United States Patent
Young

(10) Patent No.: US 12,467,224 B2
(45) Date of Patent: Nov. 11, 2025

(54) SYSTEMS AND METHODS OF PERFORMING AUTOMATED OPERATIONS WITH A POWER MACHINE

(71) Applicant: Doosan Bobcat North America, Inc., West Fargo, ND (US)

(72) Inventor: Christopher Young, Fargo, ND (US)

(73) Assignee: Doosan Bobcat North America, Inc., West Fargo, ND (US)

( * ) Notice: Subject to any disclaimer, the term of this patent is extended or adjusted under 35 U.S.C. 154(b) by 0 days.

(21) Appl. No.: 18/751,808

(22) Filed: Jun. 24, 2024

(65) Prior Publication Data

US 2025/0003176 A1 Jan. 2, 2025

Related U.S. Application Data

(60) Provisional application No. 63/510,977, filed on Jun. 29, 2023.

(51) Int. Cl.

| | |
|---|---|
| ***E02F 3/43*** | (2006.01) |
| ***E02F 3/34*** | (2006.01) |
| ***E02F 3/42*** | (2006.01) |
| ***E02F 9/20*** | (2006.01) |
| ***E02F 9/26*** | (2006.01) |

(52) U.S. Cl.

CPC ..... *E02F 3/434* (2013.01); *E02F 3/3414* (2013.01); *E02F 3/422* (2013.01); *E02F 9/2041* (2013.01); *E02F 9/207* (2013.01); *E02F 9/2095* (2013.01); *E02F 9/267* (2013.01)

(58) Field of Classification Search

CPC ..... E02F 3/434; E02F 3/3414; E02F 3/422; E02F 3/438; E02F 9/2041; E02F 9/207; E02F 9/2095; E02F 9/267; E02F 9/2004

See application file for complete search history.

(56) References Cited

U.S. PATENT DOCUMENTS

| | | | |
|---|---|---|---|
| 7,072,745 | B2 | 7/2006 | Pillar et al. |
| 10,893,642 | B2 | 1/2021 | Heckeroth |

(Continued)

FOREIGN PATENT DOCUMENTS

| | | |
|---|---|---|
| CN | 113401841 | 9/2021 |
| EP | 2933387 B1 | 8/2019 |

(Continued)

OTHER PUBLICATIONS

Muenchhof et al., M. Fault-tolerant actuators and drives—Structures, fault detection principles and applications, Google Scholar, Sciencedirect, Annual Reviews in Control, vol. 33, Iss. 2, Dec. 2009, pp. 136-148. (Year: 2009).*

(Continued)

*Primary Examiner* — Russell Frejd

(74) *Attorney, Agent, or Firm* — Quarles & Brady LLP

(57) ABSTRACT

Automated operation methods and systems are provided for power machines. One system includes an electronic processor configured to record operator commands for controlling the power machine as a recorded operation. The electronic processor is also configured to store the recorded operation in association with a start position of the recorded operation. The electronic processor is also configured to control operation of the power machine to achieve the start position and to perform the recorded operation.

8 Claims, 9 Drawing Sheets

(56) References Cited

U.S. PATENT DOCUMENTS

| | | | | |
|---|---|---|---|---|
| 2006/0047377 | A1* | 3/2006 | Ferguson | E02F 9/2054 701/2 |
| 2013/0046447 | A1 | 2/2013 | Park | |
| 2015/0275469 | A1 | 10/2015 | Fredrickson et al. | |
| 2022/0098820 | A1 | 3/2022 | Azure et al. | |
| 2022/0290402 | A1* | 9/2022 | Okada | G05D 1/0027 |
| 2022/0372726 | A1 | 11/2022 | Krieger et al. | |
| 2023/0193592 | A1* | 6/2023 | Pfaff | E02F 9/2037 701/50 |
| 2023/0228058 | A1* | 7/2023 | Young | E02F 9/264 318/434 |

FOREIGN PATENT DOCUMENTS

| | | | |
|---|---|---|---|
| JP | H02225727 | A | 9/1990 |
| JP | 2001123478 | A | 5/2001 |
| KR | 20130071880 | A | 7/2013 |

OTHER PUBLICATIONS

International Searching Authority, International Search Report and Written Opinion issued for corresponding International Application No. PCT/US2024/035203 mailed Nov. 12, 2024 [14 pgs.].

* cited by examiner

SYSTEMS AND METHODS OF PERFORMING AUTOMATED OPERATIONS WITH A POWER MACHINE

CROSS-REFERENCE TO RELATED APPLICATIONS

This application claims the benefit of and priority to U.S. Provisional Application No. 63/510,977, filed Jun. 29, 2023, the entirety of which is incorporated by reference herein.

BACKGROUND

This disclosure is directed toward power machines. More particularly, the present disclosure is directed to power machines that operate in whole or in part under electrical power. Power machines, for the purposes of this disclosure, include any type of machine that generates power for the purpose of accomplishing a particular task or a variety of tasks. One type of power machine is a work vehicle. Work vehicles, such as loaders, are generally self-propelled vehicles that have a work device, such as a lift arm (although some work vehicles can have other work devices) that can be manipulated to perform a work function. Work vehicles include loaders, excavators, utility vehicles, tractors, and trenchers, to name a few examples.

The discussion above is merely provided for general background information and is not intended to be used as an aid in determining the scope of the claimed subject matter.

SUMMARY OF THE DISCLOSURE

Some configurations of the disclosure are directed to providing automated task operation for power machines, and, in particular, electric power machines. Configurations described herein facilitate automated task operation through generation and execution of a recorded operation. Automated task operation may be utilized for executing repeated tasks, such as, e.g., dig and dump operations. For example, after lifting and dumping material into a truck bed, the operator may, with a single operator input, automate the movement of the workgroup back down from the dump position. Automated task operation may allow an operator to focus on other operations or tasks while the automated task operation is being executed, which may increase operator efficiency, accuracy, etc. Following the previous example, the automated task operation of moving the workgroup down from the dump position may allow the operator to focus on repositioning the power machine such that, once the bucket is down, the operator may engage (or dig) the next load to be lifted and dumped more quickly.

In some configurations, the technology disclosed herein may be implemented as a return to position technique. For instance, the automated operation may include controlling the power machine (or a component thereof) to return to a target position (e.g., a previous position). A target position may include, e.g., a dig position, a dump position, etc. In some configurations, the technology disclosed herein may be implemented as a replay technique. For instance, the automated operation may include controlling the power machine (or a component thereof) to perform (or repeat) a set of previously executed operator commands such that the power machine repeats the set of previously executed operator commands as if the operator commands were being received in real-time (or near real-time).

Some configurations of the present disclosure provide a system to control an electric power machine. The system may include one or more electronic processors. The one or more electronic processors may be configured to receive a set of operator commands controlling the electric power machine for execution of a power machine operation. The one or more electronic processors may also be configured to record the power machine operation as a recorded operation. The one or more electronic processors may also be configured to receive a request to perform the recorded operation. The one or more electronic processors may also be configured to, in response to receiving the request to perform the recorded operation, control one or more electrical actuators of the electric power machine to perform the recorded operation.

Some configurations described herein provide a method to control a power machine. The method may include receiving, with one or more electronic processors, a request to perform a recorded operation, the recorded operation corresponding to one or more of: a set of operator commands for controlling the power machine provided during previous operation of the power machine, or a position for the power machine provided during previous operation of the power machine. The method may also include determining, with the one or more electronic processors, a current position of an electrical actuator. The method may also include determining, with the one or more electronic processors, a difference between the current position of the electrical actuator and a target position associated with the recorded operation for the electrical actuator. The method may also include adjusting, with the one or more electronic processors, the current position of the electrical actuator based on the difference.

Some configurations described herein provide an electric power machine. The electric power machine may include a power machine frame. The electric power machine may also include a plurality of electrical actuators supported by the power machine frame, wherein the plurality of electrical actuators includes a tractive motor, a lift actuator, and a tilt actuator. The electric power machine may also include a lift arm structure. The lift arm structure may include a lift arm coupled to the power machine frame and configured to be moved relative to the power machine frame by the lift actuator. The lift arm structure may also include a work element supported by the lift arm and configured to be moved relative to the lift arm by the tilt actuator. The electric power machine may also include an electrical power source configured to power the plurality of electrical actuators. The electric power machine may also include one or more electronic processors in communication with the plurality of electrical actuators. The one or more electronic processors may be configured to, during activation of a record mode for the electric power machine, determine a position associated with the plurality of electrical actuators; and receive a set of operator commands controlling the electric power machine. The one or more electronic processors may also be configured to store the set of operator commands as a recorded operation in association with the position as a target position, the target position may be a start position to be achieved prior to performance of the recorded operation. The one or more electronic processors may also be configured to receive a request to perform the recorded operation. The one or more electronic processors may also be configured to, in response to receiving the request, control the electric power machine to achieve the target position; and control the electric power machine to automatically perform the recorded operation.

This Summary and the Abstract are provided to introduce a selection of concepts in a simplified form that are further described below in the Detailed Description. The Summary and the Abstract are not intended to identify key features or essential features of the claimed subject matter, nor are they intended to be used as an aid in determining the scope of the claimed subject matter.

BRIEF DESCRIPTION OF THE DRAWINGS

The following drawings are provided to help illustrate various features of examples of the disclosure and are not intended to limit the scope of the disclosure or exclude alternative implementations.

DETAILED DESCRIPTION OF THE PRESENT DISCLOSURE

Figure 1:
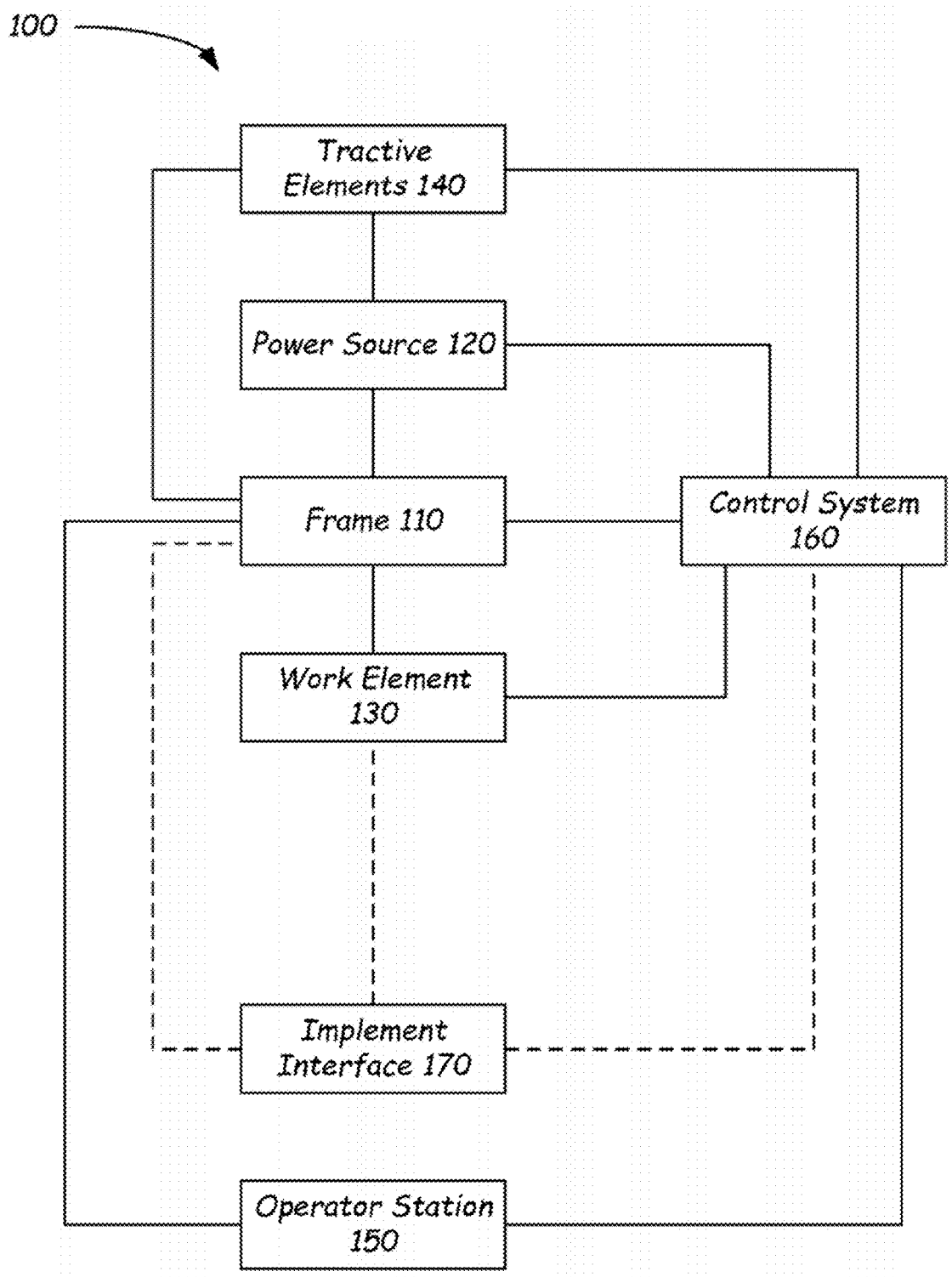
FIG. 1 is a block diagram illustrating functional systems of a representative power machine on which configurations of the present disclosure can be advantageously practiced.

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

While the power machines disclosed herein may be embodied in many different forms, several specific embodiments are discussed herein with the understanding that the embodiments described in the present disclosure are to be considered only exemplifications of the principles described herein, and the technology disclosed herein is not intended to be limited to the embodiments illustrated.

Some discussion below describes improved components and configurations for power machines, including components and configurations that use electrical (e.g., as opposed to hydraulic) power to operate certain power machine components or otherwise implement certain power machine functionality. In some configurations, electrically powered components can be mounted to a frame of a power machine to selectively move work elements of the power machine, including lift arms or implement carriers. In some configurations, electrically powered components can provide motive power for a power machine, including for tracked power machines (e.g., compact tracked loaders).

The technology disclosed herein relates to electric power machines and, more particularly, to automated operation of electric power machines. In particular, the technology disclosed herein relates to systems and methods of generating a recorded operation and controlling a power machine to perform the recorded operation (e.g., as an automated task operation). Automated task operation may be utilized for executing repeated tasks, such as, e.g., dig and dump operations, trenching operations, etc., with minimal operator input (e.g., single operator inputs to stop or start automated operation). As one example, when the recorded operation is a return to position operation, relative to lifting and dumping material into a truck bed, the operator may, with a single operator input, automate the movement of the workgroup to a dumping position or back down from the dump position (e.g., in either case, returning to a particular lift arm position).

Accordingly, in some configurations, the technology disclosed herein may be implemented as a return to position technique. For instance, the automated operation may include controlling the power machine (or a component thereof) to return to a target position (e.g., a previous position). A target position may include, e.g., a dig position, a dump position, etc.

Alternatively, or in addition, the technology disclosed herein may be implemented as a replay technique. For instance, the automated operation may include controlling the power machine (or a component thereof) to perform operations corresponding to a set of previously provided operator commands. Accordingly, for example, the power machine can repeat the set of previously executed operator commands as if the operator commands were being received in real-time (or near real-time), but without requiring the repeated input of those commands.

Figure 2:
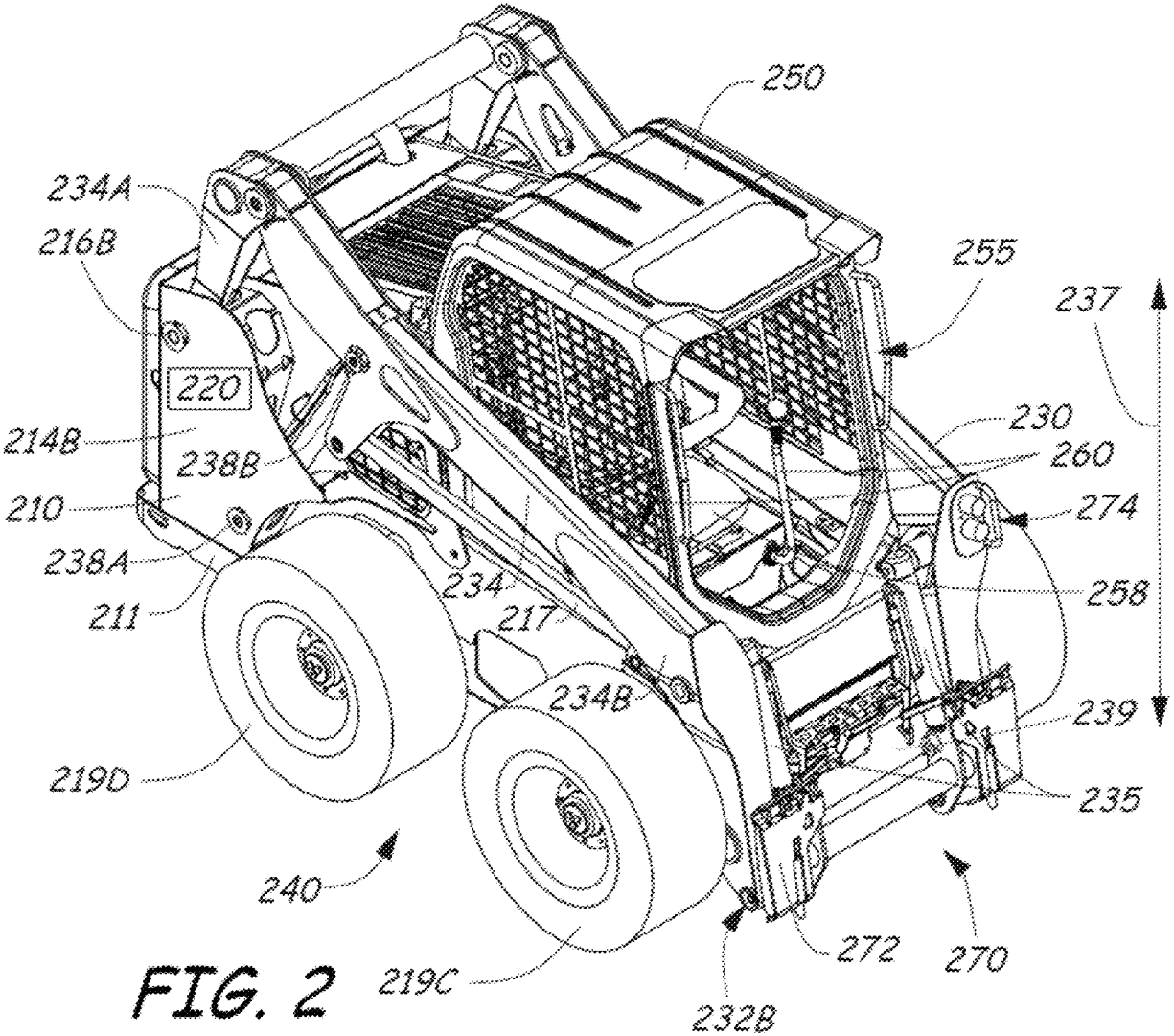
FIG. 2 is a perspective view showing generally a front of a power machine on which configurations disclosed in this specification can be advantageously practiced.
Figure 3:
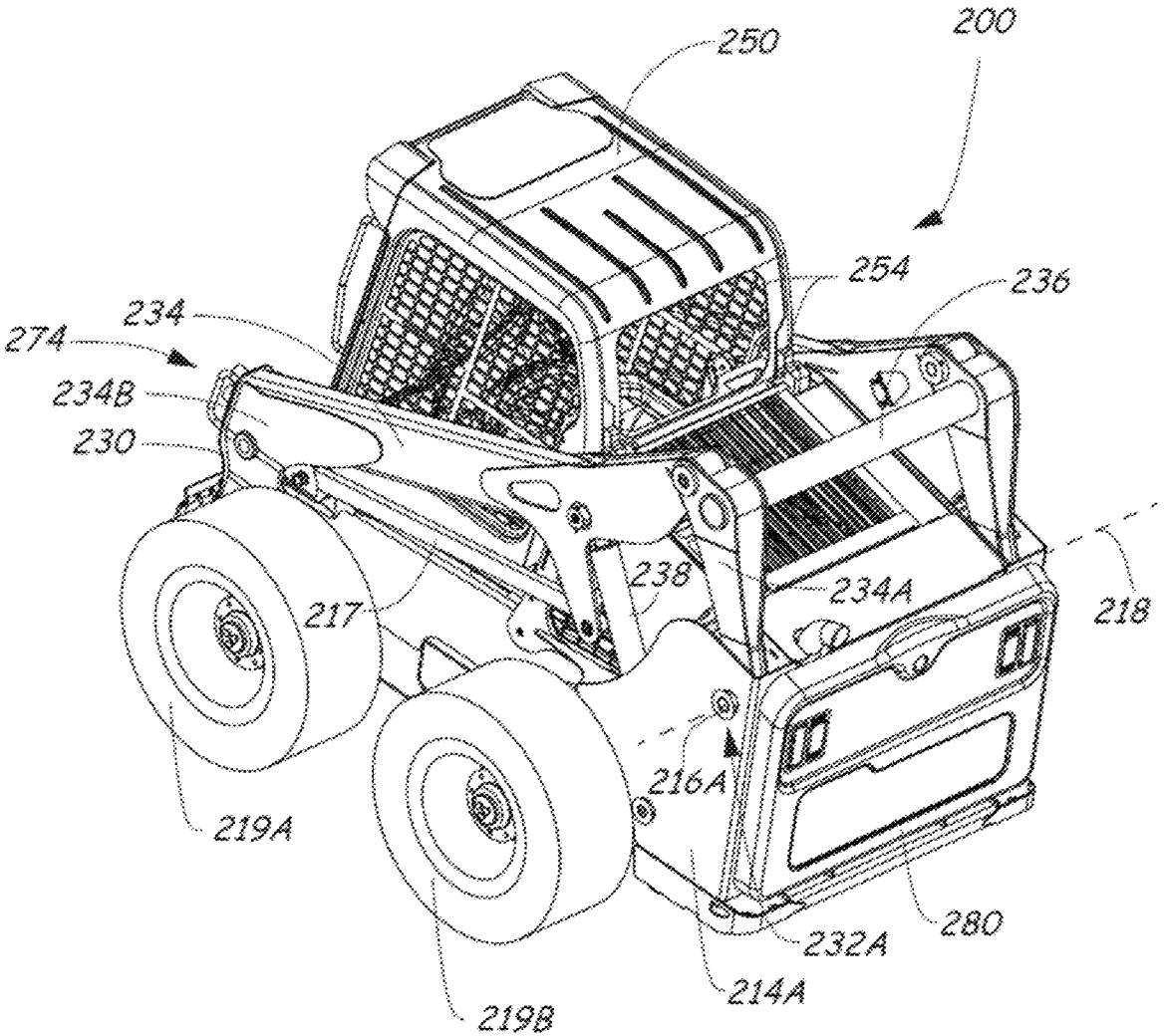
FIG. 3 is a perspective view showing generally a back of the power machine shown in FIG. 2.

These concepts can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is illustrated and discussed as being a representative power machine. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, work element, and a power source that can provide power to the work element. At least one of the work elements is a motive system for moving the power machine under power.

FIG. 1 is a block diagram that illustrates the basic systems of a power machine 100, which can be any of a number of different types of power machines, upon which the embodiments discussed below can be advantageously incorporated. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that can perform a dedicated task. For example, some work vehicles have a lift arm to which an implement such as a bucket is attached such as by a pinning arrangement. The work element, i.e., the lift arm can be manipulated to position the implement to perform the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of different implements to the work element. One characteristic of such an implement carrier is that once an implement is attached to it, it is fixed to the implement (i.e., not movable with respect to the implement) and when the implement carrier is moved with respect to the work element, the implement moves with the implement carrier. The term implement carrier as used herein is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that can move with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which is configured to provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is configured to convert the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. For example, the power machine can be a mower with a mower deck or other mower component as a work element, which may be movable with respect to the frame of the mower. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, track assemblies, wheels attached to an axle, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame.

Power machine 100 includes an operator station 150 that includes an operating position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e., from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e., remote from both of the power machine and any implement to which is it coupled) that is capable of controlling at least some of the operator-controlled functions on the power machine.

FIGS. 2-3 illustrate a loader 200, which is one particular example of a power machine of the type illustrated in FIG. 1 where the embodiments discussed below can be advantageously employed. Loader 200 is a skid-steer loader, which is a loader that has tractive elements (in this case, four wheels) that are mounted to the frame of the loader via rigid axles. Here the phrase "rigid axles" refers to the fact that the skid-steer loader 200 does not have any tractive elements that can be rotated or steered to help the loader accomplish a turn. Instead, a skid-steer loader has a drive system that independently powers one or more tractive elements on each side of the loader so that by providing differing tractive signals to each side, the machine will tend to skid over a support surface. These varying signals can even include powering tractive element(s) on one side of the loader to move the loader in a forward direction and powering tractive element(s) on another side of the loader to mode the loader in a reverse direction so that the loader will turn about a radius centered within the footprint of the loader itself. The term "skid-steer" has traditionally referred to loaders that have skid steering as described above with wheels as tractive elements. However, it should be noted that many track loaders also accomplish turns via skidding and are technically skid-steer loaders, even though they do not have wheels. For the purposes of this discussion, unless noted otherwise, the term skid-steer should not be seen as limiting the scope of the discussion to those loaders with wheels as tractive elements. Correspondingly, although some example power machines discussed herein are presented as skid-steer power machines, some embodiments disclosed herein can be implemented on a variety of other power machines. For example, some embodiments can be implemented on compact loaders or compact excavators that do not accomplish turns via skidding.

Loader 200 is one particular example of the power machine 100 illustrated broadly in FIG. 1 and discussed above. To that end, features of loader 200 described below include reference numbers that are generally similar to those used in FIG. 1. For example, loader 200 is described as having a frame 210, just as power machine 100 has a frame 110. Skid-steer loader 200 is described herein to provide a reference for understanding one environment on which the embodiments described below related to track assemblies and mounting elements for mounting the track assemblies to a power machine may be practiced. The loader 200 should not be considered limiting especially as to the description of features that loader 200 may have described herein that are not essential to the disclosed embodiments and thus may or may not be included in power machines other than loader 200 upon which the embodiments disclosed below may be advantageously practiced. Unless specifically noted otherwise, embodiments disclosed below can be practiced on a variety of power machines, with the loader 200 being only one of those power machines. For example, some or all of the concepts discussed below can be practiced on many other types of work vehicles such as various other loaders, excavators, trenchers, and dozers, to name but a few examples.

Loader 200 includes frame 210 that supports a power system 220, the power system being capable of generating or otherwise providing power for operating various functions on the power machine. Power system 220 is shown in block diagram form but is located within the frame 210. Frame 210 also supports a work element in the form of a lift arm assembly 230 that is powered by the power system 220 and that can perform various work tasks. As loader 200 is a work vehicle, frame 210 also supports a traction system 240, which is also powered by power system 220 and can propel the power machine over a support surface. The lift arm assembly 230 in turn supports an implement interface 270, which includes an implement carrier 272 that can receive and secure various implements to the loader 200 for performing various work tasks and power couplers 274, to which an implement can be coupled for selectively providing power to an implement that might be connected to the loader. Power couplers 274 can provide sources of hydraulic or electric power or both. The loader 200 includes a cab 250 that defines an operator station 255 from which an operator can manipulate various control devices 260 to cause the power machine to perform various work functions. Cab 250 can be pivoted back about an axis that extends through mounts 254 to provide access to power system components as needed for maintenance and repair.

The operator station 255 includes an operator seat 258 and a plurality of operation input devices, including control levers 260 that an operator can manipulate to control various machine functions. Operator input devices can include buttons, switches, levers, sliders, pedals and the like that can be stand-alone devices such as hand operated levers or foot pedals or incorporated into hand grips or display panels, including programmable input devices. Actuation of operator input devices can generate signals in the form of electrical signals, hydraulic signals, and/or mechanical signals. Signals generated in response to operator input devices are provided to various components on the power machine for controlling various functions on the power machine. Among the functions that are controlled via operator input devices on power machine 200 include control of the tractive elements 219, the lift arm assembly 230, the implement carrier 272, and providing signals to any implement that may be operably coupled to the implement.

Loaders can include human-machine interfaces including display devices that are provided in the cab 250 to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided. Other power machines, such walk behind loaders may not have a cab nor an operator compartment, nor a seat. The operator position on such loaders is generally defined relative to a position where an operator is best suited to manipulate operator input devices.

Various power machines that can include and/or interacting with the embodiments discussed herein can have various different frame components that support various work elements. The elements of frame 210 discussed herein are provided for illustrative purposes and frame 210 is not the only type of frame that a power machine on which the embodiments can be practiced can employ. Frame 210 of loader 200 includes an undercarriage or lower portion 211 of the frame and a mainframe or upper portion 212 of the frame that is supported by the undercarriage. The mainframe 212 of loader 200, in some embodiments is attached to the undercarriage 211 such as with fasteners or by welding the undercarriage to the mainframe. Alternatively, the mainframe and undercarriage can be integrally formed. Mainframe 212 includes a pair of upright portions 214A and 214B located on either side and toward the rear of the mainframe that support lift arm assembly 230 and to which the lift arm assembly 230 is pivotally attached. The lift arm assembly 230 is illustratively pinned to each of the upright portions 214A and 214B. The combination of mounting features on the upright portions 214A and 214B and the lift arm assembly 230 and mounting hardware (including pins used to pin the lift arm assembly to the mainframe 212) are collectively referred to as joints 216A and 216B (one is located on each of the upright portions 214) for the purposes of this discussion. Joints 216A and 216B are aligned along an axis 218 so that the lift arm assembly is capable of pivoting, as discussed below, with respect to the frame 210 about axis 218. Other power machines may not include upright portions on either side of the frame or may not have a lift arm assembly that is mountable to upright portions on either side and toward the rear of the frame. For example, some power machines may have a single arm, mounted to a single side of the power machine or to a front or rear end of the power machine. Other machines can have a plurality of work elements, including a plurality of lift arms, each of which is mounted to the machine in its own configuration. Frame 210 also supports a pair of tractive elements in the form of wheels 219A-D on either side of the loader 200.

The lift arm assembly 230 shown in FIGS. 2-3 is one example of many different types of lift arm assemblies that can be attached to a power machine such as loader 200 or other power machines on which embodiments of the present discussion can be practiced. The lift arm assembly 230 is what is known as a vertical lift arm, meaning that the lift arm assembly 230 is moveable (i.e., the lift arm assembly can be raised and lowered) under control of the loader 200 with respect to the frame 210 along a lift path 237 that forms a generally vertical path. Other lift arm assemblies can have different geometries and can be coupled to the frame of a loader in various ways to provide lift paths that differ from the radial path of lift arm assembly 230. For example, some lift paths on other loaders provide a radial lift path. Other lift arm assemblies can have an extendable or telescoping portion. Other power machines can have a plurality of lift arm assemblies attached to their frames, with each lift arm assembly being independent of the other(s). Unless specifically stated otherwise, none of the inventive concepts set forth in this discussion are limited by the type or number of lift arm assemblies that are coupled to a particular power machine.

The lift arm assembly 230 has a pair of lift arms 234 that are disposed on opposing sides of the frame 210. A first end 232A of each of the lift arms 234 is pivotally coupled to the power machine at joints 216 and a second end 232B of each of the lift arms is positioned forward of the frame 210 when in a lowered position as shown in FIG. 2. Joints 216 are located toward a rear of the loader 200 so that the lift arms extend along the sides of the frame 210. The lift path 237 is defined by the path of travel of the second end 232B of the lift arms 234 as the lift arm assembly 230 is moved between a minimum and maximum height.

Each of the lift arms 234 has a first portion 234A of each lift arm 234 is pivotally coupled to the frame 210 at one of the joints 216 and the second portion 234B extends from its connection to the first portion 234A to the second end 232B of the lift arm assembly 230. The lift arms 234 are each coupled to a cross member 236 that is attached to the first portions 234A. Cross member 236 provides increased structural stability to the lift arm assembly 230. A pair of actuators 238, which on loader 200 are hydraulic cylinders configured to receive pressurized fluid from power system 220, are pivotally coupled to both the frame 210 and the lift arms 234 at pivotable joints 238A and 238B, respectively, on either side of the loader 200. The actuators 238 are sometimes referred to individually and collectively as lift cylinders. Actuation (i.e., extension and retraction) of the actuators 238 cause the lift arm assembly 230 to pivot about joints 216 and thereby be raised and lowered along a fixed path illustrated by arrow 237. Each of a pair of control links 217 are pivotally mounted to the frame 210 and one of the lift arms 232 on either side of the frame 210. The control links 217 help to define the fixed lift path of the lift arm assembly 230.

Some lift arms, most notably lift arms on excavators but also possible on loaders, may have portions that are controllable to pivot with respect to another segment instead of moving in concert (i.e., along a pre-determined path) as is the case in the lift arm assembly 230 shown in FIG. 2. Some power machines have lift arm assemblies with a single lift arm, such as is known in excavators or even some loaders and other power machines. Other power machines can have a plurality of lift arm assemblies, each being independent of the other(s).

An implement interface 270 is provided proximal to a second end 232B of the lift arm assembly 234. The implement interface 270 includes an implement carrier 272 that is capable of accepting and securing a variety of different implements to the lift arm 234. Such implements have a complementary machine interface that is configured to be engaged with the implement carrier 272. The implement carrier 272 is pivotally mounted at the second end 232B of the arm 234. Implement carrier actuators 235 are operably coupled the lift arm assembly 230 and the implement carrier 272 and are operable to rotate the implement carrier with respect to the lift arm assembly. Implement carrier actuators 235 are illustratively hydraulic cylinders and often known as tilt cylinders.

By having an implement carrier capable of being attached to a plurality of different implements, changing from one implement to another can be accomplished with relative case. For example, machines with implement carriers can provide an actuator between the implement carrier and the lift arm assembly, so that removing or attaching an implement does not involve removing or attaching an actuator from the implement or removing or attaching the implement from the lift arm assembly. The implement carrier 272 provides a mounting structure for easily attaching an implement to the lift arm (or other portion of a power machine) that a lift arm assembly without an implement carrier does not have.

Some power machines can have implements or implement like devices attached to it such as by being pinned to a lift arm with a tilt actuator also coupled directly to the implement or implement type structure. A common example of such an implement that is rotatably pinned to a lift arm is a bucket, with one or more tilt cylinders being attached to a bracket that is fixed directly onto the bucket such as by welding or with fasteners. Such a power machine does not have an implement carrier, but rather has a direct connection between a lift arm and an implement.

The implement interface 270 also includes an implement power source 274 available for connection to an implement on the lift arm assembly 230. The implement power source 274 includes pressurized hydraulic fluid port to which an implement can be removably coupled. The pressurized hydraulic fluid port selectively provides pressurized hydraulic fluid for powering one or more functions or actuators on an implement. The implement power source can also include an electrical power source for powering electrical actuators and/or an electronic controller on an implement. The implement power source 274 also exemplarily includes electrical conduits that are in communication with a data bus on the excavator 200 to allow communication between a controller on an implement and electronic devices on the loader 200.

Frame 210 supports and generally encloses the power system 220 so that the various components of the power system 220 are not visible in FIGS. 2-3. The arrangement of drive pumps, motors, and axles in power machine 200 is but one example of an arrangement of these components. As discussed above, power machine 200 is a skid-steer loader and thus tractive elements on each side of the power machine are controlled together via the output of a single hydraulic pump, either through a single drive motor as in power machine 200 or with individual drive motors. Various other configurations and combinations of hydraulic drive pumps and motors can be employed as may be advantageous.

The description of power machine 100 and loader 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on a loader such as track loader 200, unless otherwise noted or recited, the concepts discussed below are not intended to be limited in their application to the environments specifically described above.

Figure 4:
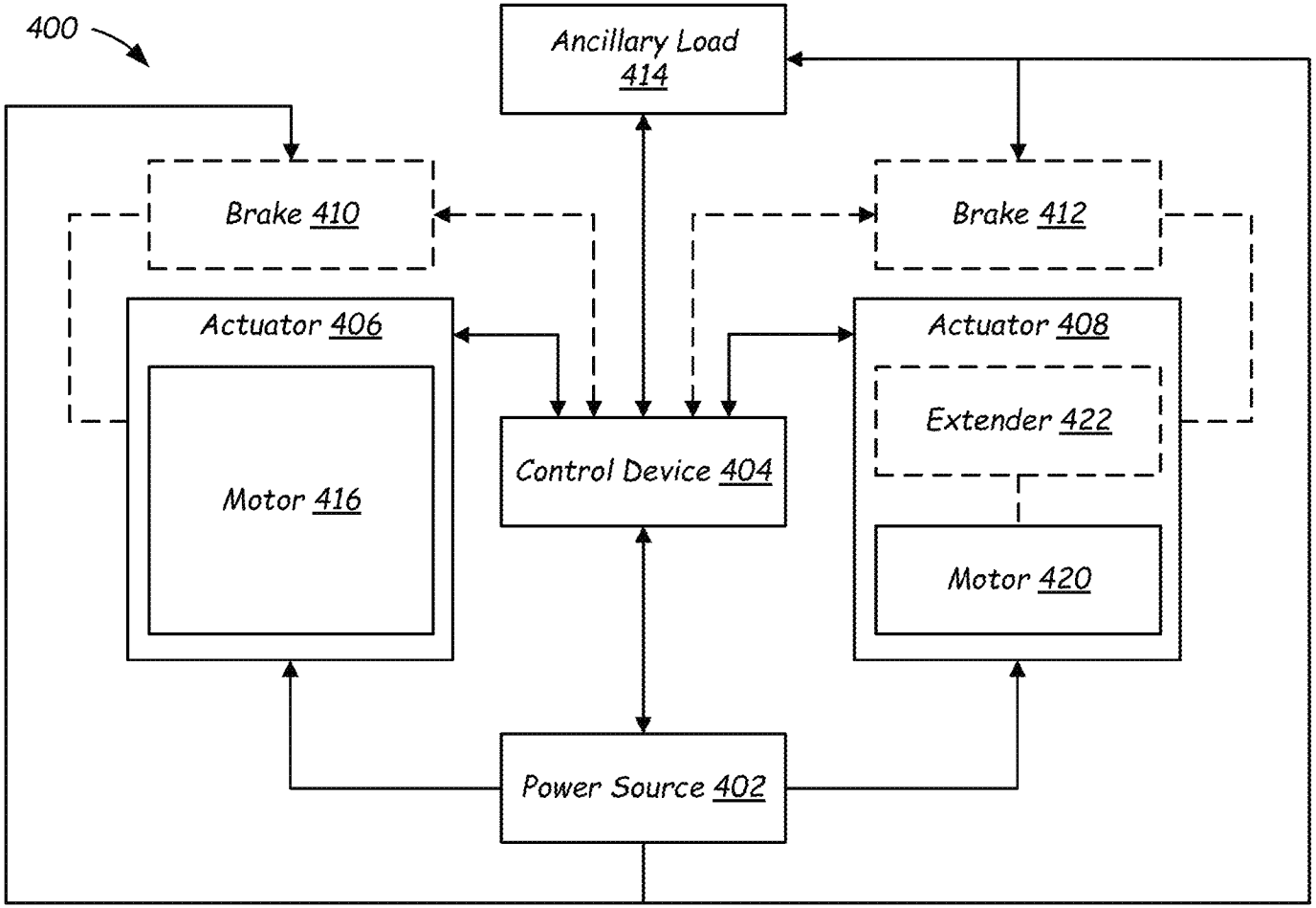
FIG. 4 is a block diagram illustrating components of a power system of the loader of FIGS. 2 and 3 or other power machines.

FIG. 4 shows a schematic illustration of a block diagram of a power machine 400, which can be any of a number of different types of power machines (e.g., wheeled or tracked skid-steer loaders), including any of the types generally discussed above. To accomplish various work and drive operations, the power machine 400 can include a power source 402, a control device 404, and electrical actuators 406, 408. Either or both of the electrical actuators 406, 408 can be variously configured as one or more drive actuators, or one or more workgroup actuators, and a different number of individual actuators can be provided than is generally shown in FIG. 4. For example, as further discussed below, some power machines can include a left-side and right-side drive actuators, each including a respective electronic drive motor disposed to power an associate tractive element (e.g., an endless track assembly), as well as various extendable (or other) work actuators (e.g., one or more extendable lift arm actuators, one or more extendable tilt actuators, etc.). In some cases, as also shown in FIG. 4, one or more brakes 410, 412 can be configured to stop movement of an associated one or more of the actuators 406, 408, including based on control signals from the control device 404.

In the illustrated example, the power machine 400 can be an electrically powered power machine and thus the power source 402 can include an electrical power source such as, for example, a battery pack that includes one or more battery cells (e.g., lithium-ion batteries). In some embodiments, the power source 402 can include other electrical storage devices (e.g., a capacitor), and other power sources. In addition, the power machine 400 can, but need not, include an internal combustion engine that provides, via a generator, electrically power to the power source 402 (e.g., to charge one or more batteries of the electrical power source).

Generally, the control device 404 can be implemented in a variety of different ways and can include one or more types or instances of known electronic controllers. For example, the control device 404 can be implemented as known types of processor devices, (e.g., microcontrollers, field-programmable gate arrays, programmable logic controllers, logic gates, etc.), including as part of one or more general or special purpose computers. In addition, the control device 404 can also include or be in operative communication with other computing components, including memory, inputs, output devices, etc. (not shown). In this regard, the control device 404 can be configured to implement some or all of the operations of the processes described herein, which can, as appropriate, be retrieved from or otherwise interact with memory. In some embodiments, the control device 404 can include multiple control devices (or modules) that can be integrated into a single component or arranged as multiple separate components. In some embodiments, the control device 404 can be part of a larger control system (e.g., the control system 160 of FIG. 1) and can accordingly include or be in electronic communication with a variety of control modules, including hub controllers, engine controllers, drive controllers, and so on.

In different embodiments, different types of actuators can be configured to operate under power from the power source 402, including electrical actuators configured as rotary actuators, linear actuators, and combinations thereof. In the example shown in FIG. 4, the actuator 406 is a drive actuator and includes an electrical motor 416 that is configured to provide rotational power to one or more tractive elements (not shown in FIG. 4). As noted above, some power machines can include multiple drive actuators, including as can be arranged for skid-steer operation.

Also as shown in the example of FIG. 4, the actuator 408 is a workgroup actuator and thus includes an electrical motor 420 that is configured to provide rotational power for operation of one or more non-drive work elements (e.g., a lift arm, an implement, etc.). In some cases, the motor 420 can be configured to power movement of an extender 422 (e.g., a lead screw, a ball screw, another similar threaded assembly, or other known components for rotationally powered non-rotational movement), which can convert rotational power of the motor 420 into translational movement of the extender 422 so as to provide translational power to a work element of the power machine 400. For example, the motor 420 can rotate in a first direction to drive extension of the extender 422 and can rotate in a second direction to drive retraction of the extender 422 when the motor rotates in a second rotational direction opposite the first rotational direction. In this way, and depending on how the electrical actuator 406 is coupled to the components of the power machine 400, extension (and retraction) of the electrical actuator 406 can, for example, raise (or lower) a lift arm of the power machine 400, change an attitude an implement of the power machine 400 (e.g., a bucket), etc.

Thus, generally, each motor 416, 420 can be controlled to implement particular functionality for the power machine 400. As generally noted above, different configurations of multiple drive or workgroup actuators can be included in some cases (e.g., multiple instances of the actuators 406, 408 as shown), to provide different functionality for a particular power machine. For example, in some configurations, the power machine 400 can include an electrical actuator that is a first lift actuator on a first lateral side of the power machine 400, an electrical actuator that is a second lift actuator on a second lateral side of the power machine 400, an electrical actuator that is a first tilt actuator that is on a first lateral side of the implement interface of the power machine 400, an electrical actuator that is a second tilt actuator that is on a second lateral side of the implement interface of the power machine 400, an electrical actuator that is a first drive actuator for a first drive system that is on (or otherwise powers one or more tractive elements for) the first lateral side of the power machine 400, and an electrical actuator that is a second drive actuator for a second drive system that is on (or otherwise powers one or more tractive elements for) the second lateral side of the power machine 400.

As also noted above, the brakes 410, 412 can be coupled to (e.g., included in) the respective electrical actuators 406, 408 in some embodiments. In this regard, a wide variety of known brake systems can be used. For example, one or more brakes can be a mechanical brake that includes a mechanical stop that can be moved into engagement to block movement of a relevant extender or relevant motor, in one or more directions, and can be moved out of engagement to allow movement of the relevant extender or motor. In some cases, a mechanical brake can include an arm that contacts a lead screw of an extender to block further movement of the lead screw. In some embodiments, one or more electrically powered brakes can be provided (i.e., brake assemblies that include one or more electrical actuators for application of braking force).

As shown in FIG. 4, the power source 402 can be electrically connected to the control device 404, the electrical actuators 406, 408, and the brakes 410, 412 (as appropriate), as well as one or more ancillary loads 414. Thus, the power source 402 can provide power to each motor 416, 420 to drive movement (e.g., extension and retraction) of the respective extenders 418, 422, to the control device 404, to each brake 410, 412 (as appropriate), to each of the ancillary load(s) 414, etc. Further, the power source 402 can provide power to the ancillary loads 414 (i.e., loads not associated with providing tractive or workgroup power) for various ancillary functionality. For example, ancillary loads 414 can include a climate control system (e.g., including a heater, an air-conditioning system, a fan, etc.), a sound system (e.g., a speaker, a radio, etc.), etc. In some cases, ancillary loads 414 may be treated with lower priority according to certain power management modes.

As shown in FIG. 4, the control device 404 can be in electrical communication with the power source 402, the actuators 406, 408, the brakes 410, 412 (as appropriate), and the ancillary load(s) 414, and can adjust (e.g., limit) the power delivered from the power source 402 to, or the power consumed by, each of these electrical loads (or others). For example, as appropriate, the control device 404 can adjust (e.g., decrease) the power delivered to each of these electrical loads by adjusting (e.g., decreasing) the current that can be consumed by at least some of these electrical loads. In some cases, the control device 404 can adjust the current delivered to an electrical load by adjusting a driving signal delivered to a current source (e.g., a voltage controlled current source) that can be electrically connected to the electrical load (e.g., integrated within a power electronics driver board, such as a motor driver) to deliver current to the electrical load. For example, the current source can include one or more field-effect transistors, and the driving signal can be the voltage applied to the one or more field-effect transistors to adjust the current delivered and thus the power delivered to the electrical load (e.g., the motor).

In some embodiments, similarly to each of the electrical loads of the power machine 400, the electrical power source of the power source 402 can include (or can be otherwise electrically connected to) a current source (e.g., a power electronics board) that adjusts (e.g., and can restrict) the amount of power to be delivered to the electrical loads of the power machine 400. In this case, the control device 404 can adjust the driving signal to the electrical power source to adjust the total amount of current and thus the amount of power delivered to the electrical loads of the power machine 400. For example, the control device 404 can adjust the output from the electrical power source 402 to regulate the torque, position, direction, and speed of one or more motors powered by the power source 402.

In some embodiments, the control device 404 can be configured to determine a present (i.e., temporally current) power usage of one or more actuators or other electrical loads, or a present power delivery from a power source. In some cases, a present power usage or delivery can be measured instantaneously. In some cases, a present power usage or delivery can be measured as an average power delivery over a recent time interval (e.g., a preceding 2 seconds). Thus, for example, the control device 404 can determine a present power usage for each electrical load of the power machine 400, or can determine a present power delivery from the electrical power source of the power source 402.

In some cases, each electrical load of the power machine 400, and the power source 402 can include or can otherwise be electrically connected to a current sensor to determine the current being provided to (or by) the particular electrical component, and a voltage being provided to (or by) the particular electrical component can also be determined (e.g., based on voltage sensor or a fixed voltage provided by the power source 402). In this way, for example, the control device 404 can receive information about a present voltage and a present current that is delivered to each individual electrical load, or about the present voltage and current that is supplied by the electrical power source of the power machine 400 in total and can thereby determine a present power usage for relevant (e.g., all) electrical loads and for the electrical power source of the power machine 400.

In some embodiments, the control device 404 can determine a present power usage for the electrical power source of the power machine 400 by adding the present power usage for each relevant electrical load of the power machine 400 (e.g., as determined by multiplying current and voltage for the loads). Alternatively, for example, power can be determined by multiplying the torque and speed of one or more relevant motors. In certain circumstances, it may be advantageous to use either of these known methods. In other cases, the control device 404 can determine a present power usage of the electrical power source of the power machine 400 only by determining the power delivered by the electrical power source. For example, the control device 404 can receive a present value for current delivered by the electrical power source 402 and, based on the voltage of the electrical power source 402, can then determine a total present power usage for the electrical power source. In some cases, the control device 404 can assume a substantially constant voltage for the electrical power source and can then determine the present power usage of the electrical power source by using the constant voltage and the present current value.

In some embodiments, the electrical power source 402 can include or can be electrically connected to a sensor to sense a present remaining energy of the electrical power source. In some cases, for example, a voltage sensor can sense the voltage of the electrical power source, which can be indicative of the present remaining energy left within the electrical power source (e.g., because the voltage of the electrical power source can be related to the present remaining energy within the electrical power source). Any suitable means for sensing the remaining energy of the electrical power source can be used, including an accounting of how much current is supplied by the energy storage device over time.

Figure 5:
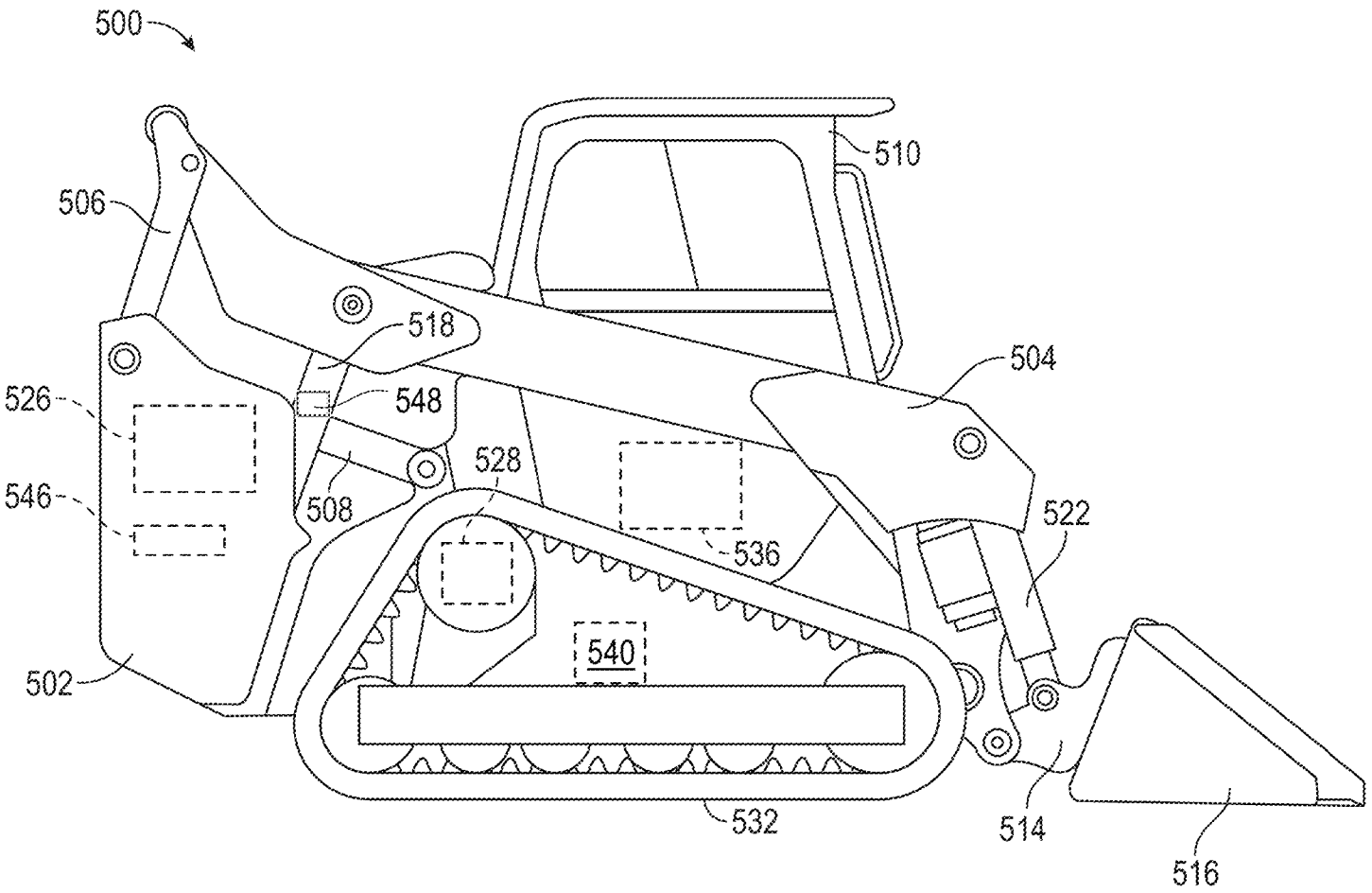
FIG. 5 is a side elevation view showing certain components of a power machine in the form of an electrically powered compact tracked loader according to configurations of the disclosure.

In some embodiments, the power machine 400 can include one or more sensors that can sense various aspects of the power machine 400. For example, the power machine 400 can include a torque sensor for one or more electrical actuators, to sense a present torque of the one or more electrical actuator. In some cases, the torque sensor can be the same as the current sensor electrically connected to the electrical actuator (e.g., because current is related to the torque). As another example, the power machine 400 can include a position sensor for one or more extenders or other components of one or more electrical actuators (as appropriate), including as may sense a present extension amount for an extender of an electrical actuator (e.g., relative to the housing of the electrical actuator). In some cases, this can be a hall-effect sensor, a rotary encoder for the motor (e.g., which can be used to determine the extension amount of actuators with extenders), an optical sensor, etc. In some cases, as shown in FIG. 5, the power machine 400 can include a resolver 548 configured to track relative movement of the actuator 518. As yet another example, the power machine 400 can include an angle sensor for one or more pivotable joints (e.g., of the lift arm) to determine a current orientation of the lift arm (and any implement coupled thereto). As yet another example, the power machine 400 can include a speed sensor or an acceleration sensor (e.g., an accelerometer) to respectively determine a current speed or a current acceleration of the entire power machine 400 or of a component thereof. As still yet another example, the power machine 400 can include an inclinometer (e.g., an accelerometer) that can sense the current attitude of a mainframe of the power machine 400 with respect to gravity.

FIG. 5 shows a side isometric view of an electrically powered power machine 500 with a lift arm in a fully lowered position, which can be a specific implementation of the power machine 200, the power machine 400, etc. As shown in FIG. 5, the power machine 500 can include a main frame 502, a lift arm 504 coupled to the main frame via a follower link 506, a driver link 508 pivotally coupled to the lift arm 504 and the main frame 502, an operator enclosure 510 (e.g., a cab, as shown), an implement interface 514 coupled to an end of the lift arm 504, an implement 516 (e.g., a bucket as shown) coupled to the implement interface 514, an electrical lift actuator 518, an electrical tilt actuators 522, an electrical power source 526, a drive system 528 (e.g., including an electrical drive motor), a traction devices 532 (e.g., an endless track, as shown), and a climate control system 536 (e.g., as generally representative of an ancillary electrical load). In some embodiments, a suspension system 540 (e.g., a torsional suspension system) can be included, to provide improved ride control and overall smoothness of travel. As generally noted above, similar (e.g., substantially identical) other components can be provided symmetrically (or otherwise) on an opposing lateral side of the power machine 500 in some cases, including another electrical lift actuator, another electrical tilt actuator, etc.

In some cases, the electrical power source 526 can be implemented in a similar manner as the previously described power sources (e.g., the power source 402). Thus, the electrical power source 526 can include a battery pack including one or more batteries. In general, the electrical power source 526 can supply power to some or all of the electrical loads of the power machine 500. For example, the electrical power source 526 can provide power to the lift electrical actuator 518, the electrical tilt actuator 522, the drive system 528, the climate control system 536, etc.

The power machine 500 can also include a control device 546 (e.g., a general or special purpose electronic computer or other electronic controller) that can be in communication with the power source 526 and some (or all) of the electrical loads of the power machine 500, as appropriate. For example, the control device 546 can be in communication with the lift electrical actuator 518, the electrical tilt actuator 522, the drive system 528, the climate control system 536, etc. In this way, the control device 546 can control operation of these components, or related other systems, to adjust how power is routed to each of these electrical loads (e.g., depending on the criteria defined by a particular power management mode) and, correspondingly, how these components operate under power from the power source 526.

Figure 6:
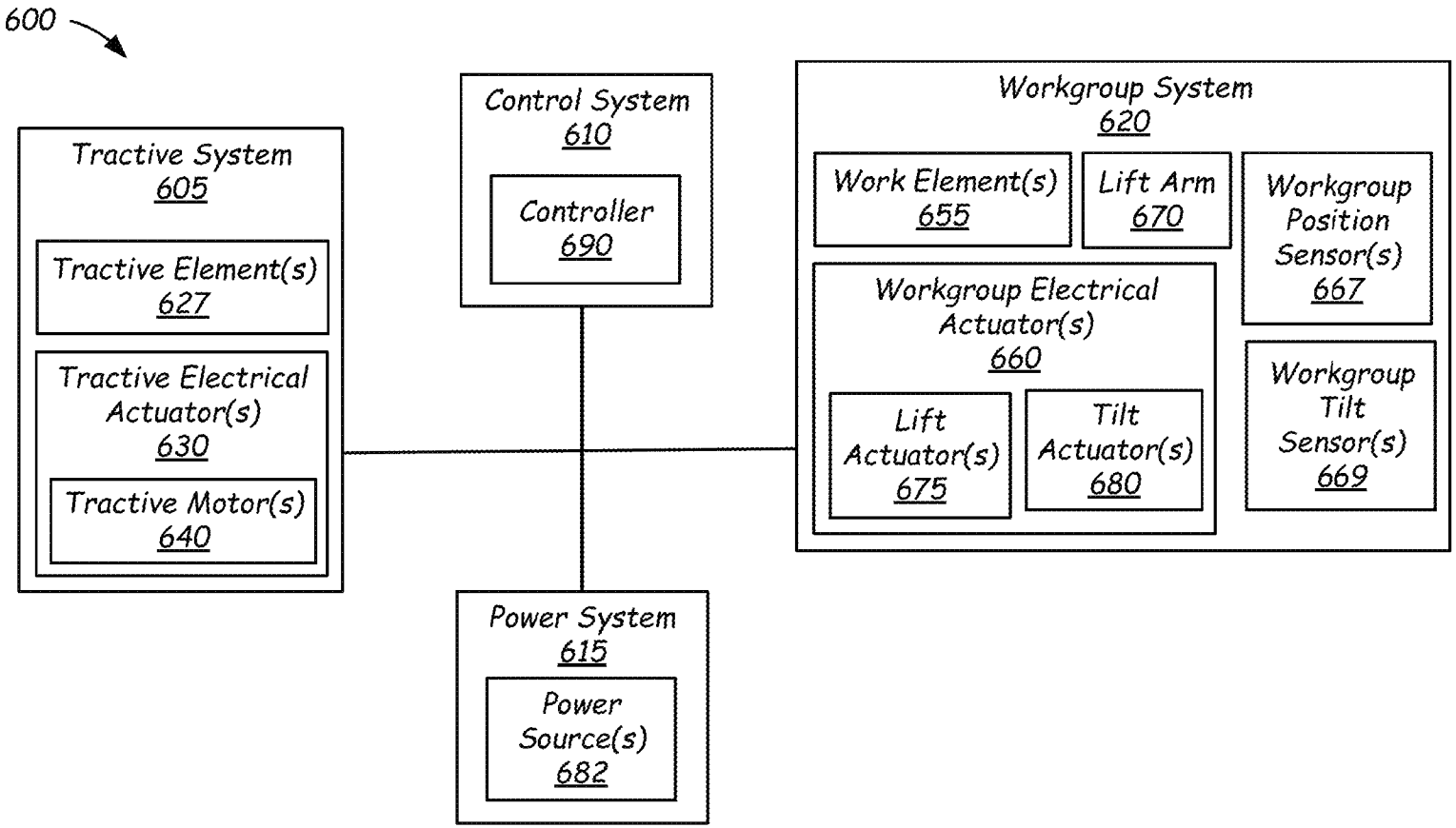
FIG. 6 is a block diagram of a power machine according to some configurations.

FIG. 6 schematically illustrates a power machine 600 according to some configurations. In the example illustrated in FIG. 6, the power machine 600 includes a tractive (or drive) system 605, a control system 610 (e.g., the control system 160, as described above), a power system 615, and a workgroup system 620. The tractive system 605, the control system 610, the power system 615, and the workgroup system 620 communicate over one or more communication lines or buses. The power machine 600 may include additional, fewer, or different components than those illustrated in FIG. 6 in various configurations and may perform additional functionality than the functionality described herein. For example, the power machine 600 may include additional, similar, or different components, systems, and functionality as described above with respect to the power machine 100 of FIG. 1, the loader 200 of FIGS. 2-3, the power machine 400 of FIG. 4, the power machine 500 of FIG. 5, or another power machine described herein.

As illustrated in FIG. 6, the power machine 600 includes the tractive system 605 (e.g., the traction system 240 of FIG. 2), which is configured to propel the power machine 600 over terrain or, more generally, a support surface. In the illustrated example, the tractive system 605 includes one or more tractive elements 627 (for example, the tractive elements 140 of FIG. 1), and one or more tractive electrical actuators 630 (for example, the actuator 406, 408 of FIG. 4). The tractive system 605 may include additional, fewer, or different components than those illustrated in FIG. 6 in various configurations and may perform additional functionality than the functionality described herein.

The one or more tractive elements 627 may be referred to herein collectively as "the tractive elements 627" or individually as "the tractive element 627." As described above, with respect to FIG. 1, the tractive elements 627 may be work elements themselves that are provided to move the power machine 600 over a support surface. The tractive elements 627 can be, e.g., track assemblies, wheels attached to an axle, and the like. The tractive elements 627 can be mounted to a power machine frame of the power machine 600 (e.g., the frame 110, as described above) such that movement of the tractive elements 627 is limited to rotation about an axle (so that steering is accomplished by a skidding action) or, alternatively, pivotally mounted to the power machine frame to accomplish steering by pivoting the tractive element with respect to the frame.

In some configurations, each tractive element 627 may be driven (or controlled) by a corresponding tractive electrical actuator (e.g., the tractive electrical actuator 630). In the illustrated example, the tractive electrical actuator(s) 630 of the tractive system 605 may include one or more tractive motors 640 (e.g., drive motors).

The power machine 600 also may include the workgroup system 620 (also referred to herein as a lift arm structure). In the illustrated example, the workgroup system 620 may include one or more work elements 655 (e.g., the work element 130 of FIG. 1 or the implement 516 of FIG. 5), one or more workgroup electrical actuators 660, one or more workgroup position sensors 667 (e.g., including one or more workgroup tilt sensors 669), and a lift arm 670 (e.g., the lift arm assembly 230 or a component thereof, as described herein).

In the illustrated example, the workgroup electrical actuators 660 of the workgroup system 620 include a lift actuator 675 and a tilt actuator 680 (e.g., an electrical lift actuator and an electrical tilt actuator, respectively). Generally, lift and tilt actuators corresponding to the lift actuator 675 and the tilt actuator 680 are described in greater detail herein with respect to FIGS. 1-5. The workgroup position sensors 667 can be configured to measure a linear extension or angular orientation of an actuator or other component of a workgroup, with the tilt sensor 669 in particular arranged to measure a degree of tilt between the work element 655 and the lift arm 670 (although other tilt measurements are possible).

The workgroup position sensor(s) 667 may collect position data for the power machine 600 (or a component thereof). As one example, the workgroup position sensor 667 may be associated with one of the workgroup electrical actuators 660, and may detect position data for the associated workgroup electrical actuator 660 (e.g., rotational position data for an electric servo motor). As another example, the workgroup position sensors 667 may be associated with each extender of each workgroup electrical actuator 630. Accordingly, in some configurations, the workgroup position sensors 667 may sense a present or current extension amount (as position data) for the extender of each workgroup electrical actuator 660 (e.g., an extension distance relative to a housing of the workgroup electrical actuator 660). In some cases, the workgroup position sensor 667 may be a hall-effect sensor, a rotary encoder for the motor (e.g., which can be used to determine the extension amount of actuators with extenders), an optical sensor, etc. Accordingly, in some configurations, position data may include a lift height of the lift arm 670 or the work element 655, an extension amount associated with the lift actuator 675, or the like.

As a specific implementation of a position sensor, the workgroup tilt sensor(s) 669 may collect tilt or orientation data for the power machine 600 (or a component thereof). In some configurations, the workgroup tilt sensor 669 may be an angle sensor for each pivotable join of the lift arm 670 of the power machine 600 to determine a current orientation of the lift arm 670 (or the work element(s) 655 coupled thereto). In some configurations, the workgroup tilt sensor 669 may determine a current attitude of a work element 655 relative to the lift arm 670 (e.g., a degree of tilt of an attached bucket or other implement)

The power machine 600 may also include the power system 615 (e.g., the power source 120 of FIG. 1, the power system 220 of FIG. 2, etc.). In the illustrated example of FIG. 6, the power system 615 may include one or more power sources 682. As described herein, the power system 615 (via one or more of the power sources 682) may generate or otherwise provide electrical power for operating various functions on the power machine 600 (or components thereof). The power system 615 may provide electrical power to various components of the power machine 600, such as, e.g., one or more components of the tractive system 605, control system 610, the workgroup system 620, or the like. Accordingly, the power machine 400 can be an electrically powered power machine and, thus, the power source(s) 682 of the power system 615 can include electrical power sources, such as, e.g., a battery pack that includes one or more battery cells (e.g., lithium-ion batteries). In some configurations, the power system 615 can include other electrical storage devices (e.g., a capacitor), and other power sources. Alternatively, or in addition, the power machine 600 can, but need not, include an internal combustion engine that provides, via a generator, electrically power to the power sources 682 (e.g., to charge one or more batteries of the electrical power system 615).

The power machine 600 may also include the control system 610. The control system 610 (e.g., the control system 160 of FIG. 1) is configured to receive operator input or other input signals (e.g., sensor data, such as speed data, position data, tilt or orientation data, or a combination thereof) and to output commands accordingly to control operation of the power machine 600. For example, the control system 610 can communicate with other systems of the power machine 600 to perform various work tasks, including to control the tractive electrical actuator(s) 630, the workgroup electrical actuator(s) 66, or a combination thereof for performing a tractive operation (e.g., travel across a support surface), a work task operation (e.g., a digging operation etc.), another operation of the power machine 600, or a combination thereof.

In some configurations, the control system 610 receives input from an operator input device, such as one of the operator input devices 262 of FIG. 2, including input as command signals provided by an operator of the power machine 405 via the operator input device 262 (also referred to herein as operator commands). As one example, an operator command or command signal may include a commanded tilt or lift for the workgroup system 620 of the power machine 600 (e.g., a change in tilt or lift of the work element at which the operator of the power machine 600 requests or commands). In response to receiving the input, the control system 610 may control the power machine 600 to perform the requested operation or otherwise maneuver based at least in part on the input received from the operator input device, the sensed operation data, or a combination thereof. Accordingly, in some configurations, the control system 610 may receive an input parameter corresponding to an operator command or input associated with operating the power machine 600, sensed operation data associated with the power machine 600, or a combination thereof.

Figure 7:
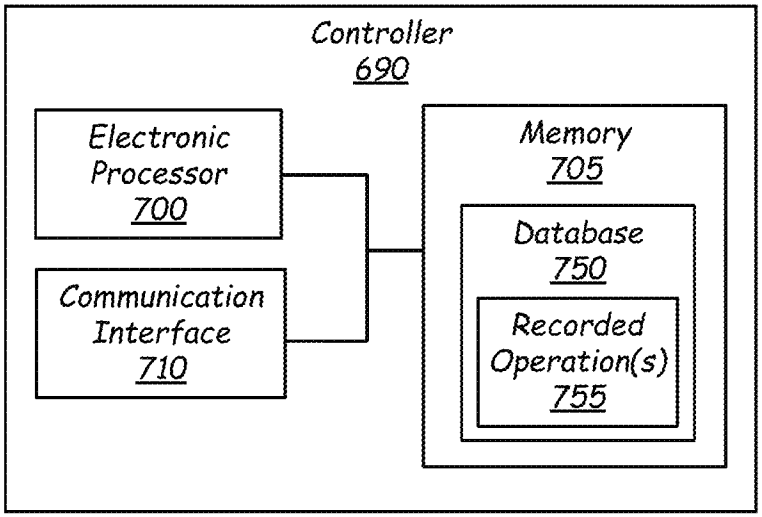
FIG. 7 schematically illustrates a controller of the power machine of FIG. 6 according to some configurations.

As illustrated in FIG. 6, the control system 610 includes a controller 690 (e.g., the control device(s) 404 as described herein). FIG. 7 illustrates the controller 690 according to some configurations. In the illustrated example of FIG. 7, the controller 690 includes an electronic processor 700 (for example, a microprocessor, an application-specific integrated circuit ("ASIC"), or another suitable electronic device), a memory 705 (for example, a non-transitory, computer-readable medium), and a communication interface 710. The electronic processor 700, the memory 705, and the communication interface 710 communicate over one or more communication lines or buses. The controller 690 may include additional components than those illustrated in FIG. 7 in various configurations and may perform additional functionality than the functionality described herein. As one example, in some embodiments, the functionality described herein as being performed by the controller 690 may be distributed among other components or devices (e.g., one or more electronic processors).

The communication interface 710 allows the controller 690 to communicate with devices external to the controller 690. For example, as illustrated in FIG. 6, the controller 690 may communicate with the tractive system 605 (or component(s) therein), the workgroup system 620 (or component(s) therein), other components or systems of the power machine 600, or a combination thereof through the communication interface 710.

The communication interface 710 may include a port for receiving a wired connection to an external device (for example, a universal serial bus ("USB") cabled and the like), a transceiver for establishing a wireless connection to an external device (for example, over one or more communication networks, such as the Internet, local area network ("LAN"), a wide area network ("WAN"), a controller area network ("CAN"), and the like), or a combination thereof. In some configurations, the controller 690 can be a dedicated or stand-alone controller. In some configurations, the controller 690 can be part of a system of multiple distinct controllers (e.g., a hub controller, a drive controller, a workgroup controller, etc.) or can be formed by a system of multiple distinct controllers (e.g., also with hub, drive, and workgroup controllers, etc.).

The electronic processor 700 is configured to access and execute computer-readable instructions ("software") stored in the memory 705. The software may include firmware, one or more applications, program data, filters, rules, one or more program modules, and other executable instructions. For example, the software may include instructions and associated data for performing a set of functions, including the methods described herein.

For example, as illustrated in FIG. 7, the memory 705 may store a database 750 including one or more recorded operation(s) 755 (referred to herein collectively as "the recorded operations 755" and individually as "the recorded operation 755"). Alternatively, or in addition, in some configurations, the database 750 (including one or more of the recorded operations 755 thereof) may be stored remotely, such as, for example, in a memory of a user device, or another remote device or database, such that each recorded operation 755 is accessible by the controller 690. As described in greater detail herein, the recorded operation 755 may be a recorded power machine operation (e.g., operational data, such as a series of positions, operator command(s), etc. associated with performing a particular work task or operation). Alternatively, or in addition, the recorded operation 755 may include one or more recorded target positions (as opposed to a set of operations), as described in greater detail herein. Example recorded operations are described in greater detail herein with respect to FIGS. 8 and 9.

Figure 8:
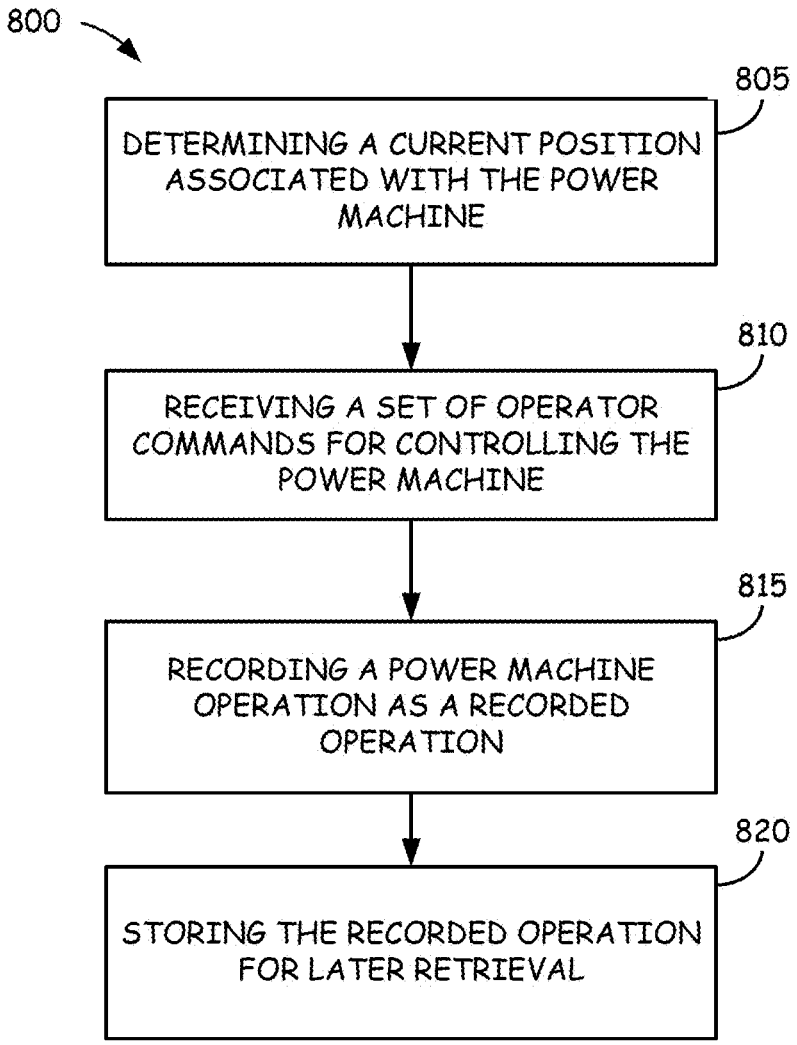
FIG. 8 is a flowchart for generating a recorded operation with the power machine of FIG. 6 according to some configurations.

FIG. 8 is a flowchart illustrating a method 800 for generating a recorded operations (e.g., the recorded operations 755) for a power machine (e.g., the power machine 600) according to some configurations. In some configurations, the method 800 can be performed by the control system 610 (e.g., the controller 690) and, in particular, by the electronic processor 700 of the controller 690. However, as noted above, the functionality described with respect to the method 800 may be performed by other devices or can be distributed among a plurality of devices or components (e.g., one or more electronic processors).

As illustrated in FIG. 8, the method 800 may include determining a current position associated with the power machine 600 (at block 805). As further discussed below, the current position determined at block 805 can be a target starting position for a set of recorded (and repeated) operations or can be a target position to which a particular component or system is to be returned to. In some configurations, the electronic processor 700 may determine a set of current positions associated with the power machine 600, including a set of positions specifying a current orientation of one or more components of the power machine 600. A current position may be a current pose of the power machine 600 as a whole, or of a component or system thereof. The current position may be a pose associated with the workgroup system 620, such as, e.g., a pose of the work element(s) 655, the lift arm 670, etc. For example, the current position may be a current position of one or more components of the workgroup system, such as, e.g., one or more of the workgroup electrical actuators 660 (e.g., the lift actuator(s) 675, the tilt actuator(s) 680, etc.). Accordingly, in some configurations, the current position of the power machine 600 may include a current lift position of the lift actuator(s) 675, a current tilt position of the tilt actuator(s) 680, or a combination thereof. As another example, the current position may be a current position of one or more components of the tractive system 605, such as, e.g., one or more of the tractive electrical actuators 630 (e.g., the tractive motor(s) 640). Accordingly, in some configurations, the current position of the power machine 600 may include a current position of the tractive electrical actuator(s) 630. For example, when the power machine 600 is integrated with a localization system (e.g., a global positioning system (GPS) or another type of navigation system), the power machine 600 may follow a recorded path based on a recorded starting position (e.g., the current position of the tractive electrical actuator(s) 630). Accordingly, in some configurations, localization (e.g., position awareness on a ground via, e.g., GPS) may be used to ensure the power machine 600 follows the same (or substantially the same) path that was recorded by the power machine 600, as described in greater detail herein.

In some configurations, the electronic processor 700 may determine the current position based on sensor data (e.g., sensed operation data). For instance, the electronic processor 700 may receive sensor data describing positional characteristics of the power machine 600. Correspondingly, the electronic processor 700 may receive sensor data from the workgroup position sensor(s) 667, the workgroup tilt sensor(s) 669, or another component of the power machine 600 and can then determine the current position at block 805 based on the received sensor data. As one example, the electronic processor 700 may receive, from the workgroup tilt sensor(s) 669, tilt data describing a current tilt position of the tilt actuators 680. The electronic processor 700 may determine a current position with respect to the tilt actuator 680 (or, similarly, a current tilt orientation of a tilted component) based on the received tilt data. Alternatively, or in addition, in some configurations, the electronic processor 700 may determine the current position based on input received from the operator input devices (e.g., via a current or most-recently received operator commands for controlling the power machine 600). For example, the electronic processor 700 may determine the current tilt position of the work element 655 based on the most-recent (or current) operator command for controlling the tilt actuator 680 associated with the work element 655. Accordingly, in some configurations, the electronic processor 700 may determine the current position based at least in part on the input received from the operator input device, the sensed operation data, or a combination thereof.

In some implementations, the electronic processor 700 may receive a set of operator commands for controlling the power machine 600 (at block 810). The set of operator commands may also be referred to herein individually as "the operator command" or collectively as "the operator commands." The operator command may include input received via the operator input device(s) from an operator of the power machine 600. The operator command(s) may include, e.g., a lift command, a tilt command, a tractive command, a float mode activation, another mode activation, another operational command, etc. In particular, a float mode can correspond to an actuator being controlled to allow a lift arm, implement, or other work element to move under external loads (e.g., without actively powered resistance, or with actively powered resistance to slow but not stop movement in response to changing loads). The operator command(s) may be received while the operator controls the power machine 600. Accordingly, in some configurations, the operator command(s) may be sequentially received in real-time (or near real-time) while the operator controls the power machine 600 via interaction with the operator input device(s). Alternatively, or in addition, in some configurations, the operator command may include an indication of a particular position (e.g., such as for a return to position operation). For instance, the operator command may include an operator pressing and holding a button or switch on a joystick (e.g., the operator input device(s)) to indicate the current position of the power machine 600 as the desired position to be returned to when the recorded operation is repeated.

In response to receiving the operator command(s), the electronic processor 700 may control operation of the power machine 600 (or component(s) thereof) in accordance with the received operator command(s). For instance, in some configurations, the electronic processor 700 may generate and transmit one or more control signals to corresponding components of the power machine 600 such that the corresponding components of the power machine 600 execute or perform the operator commands. As noted herein, the functionality (or a portion thereof) described herein as being performed by the electronic processor 700 may be performed by another device or distributed among multiple devices. As such, in some instances, another device (e.g., another controller or control device of the control system 610) may be configured to control operation of the power machine 600 (or component(s) thereof) in accordance with the received operator command(s) (rather than, e.g., the electronic processor 700).

In some implementations, the electronic processor 700 may determine a current position at block 805 but may not then subsequently receive a corresponding set of operator commands at block 810. For example, as further discussed below, operations at block 805 may include determining a current position to which the power machine will later be returned.

In some configurations, the electronic processor 700 records a power machine operation as a recorded operation (at block 815). In some configurations, the electronic processor 700 may record the operator comment(s) as the power machine operation. The electronic processor 700 may record the operator commands while the power machine 600 (or component(s) thereof) performs the operator commands. In some configurations, the electronic processor 700 may generate a dataset associated with the operator commands, where each data entry or point included in the dataset is associated with an operator command. In some instances, in response to receiving each operator command, the electronic processor 700 may generate a data entry representative of or describing that operator command. The operator commands may correspond to or be included in the performance of a particular work task or operation (e.g., performance of the particular work task or operation includes performance of each operator command). Accordingly, the operator commands may be recorded as a recorded operation, such that the operator commands are associated with performing a particular work task or operation (i.e., the recorded operation). In some configurations, the recorded operation may include a single operator command. For example, the recorded operation may include an operator command to raise or lower a lift arm, or tilt an implement in a particular direction by a particular degree. Alternatively, or in addition, the recorded operation may include multiple operator commands. For example, the recorded operation may include operator commands associated with performing a dig and dump operation (e.g., as a set of commands for a combination of tractive and workgroup operation).

In different implementations, recording a power machine operation at block 810 may include recording different operational data. In some cases, recording a power machine operation can include recording a series of positions of one or more actuators or other components (or derivatives thereof), which collectively correspond to a particular movement (or other operation) of the power machine over time. In some cases, recording a power machine operation can include recording operator commands (e.g., as received at a joystick or other input device, or as transmitted by a control system to one or more relevant actuators or actuator controllers). In some cases, however, it may be preferable to record position rather than operator commands. For example, recording of positions may allow for more reliable repetition of particular operations in view of the potential changes in loading on relevant actuators (e.g., changes in loading of a bucket, with respect to lifting, dumping, digging, or other lift arm operations).

Relatedly, and as also noted above, some implementations may be utilized to return a power machine (or power machine component) to a particular position rather than repeating a particular set of operations (e.g., to return a lift arm or other workgroup component to a particular position relative to a frame of the power machine). Some implementations may therefore not include receiving relevant operator commands at block 810. Correspondingly, operations at block 815 can sometimes include recording a target position (e.g., the determined position from block 805), and may not necessarily include recording corresponding commands.

The electronic processor 700 may store the recorded operation (at block 820). For instance, in some configurations, the electronic processor 700 may store the recorded operation 755 in the database 750 of the memory 705. Alternatively, or in addition, in some configurations, the electronic processor 700 may transmit the recorded operation 755 to a remote device for storage.

In some examples, the electronic processor 700 may store the recorded operation in association with the current position (e.g., as determined at block 805). For example, the current position determined at block 805 may be a start position for the recorded operation. Correspondingly, when performance of the recorded operation is requested, the recorded operation may be performed relative to (or from) the start position (e.g., the current position as determined at block 805), as described in greater detail herein.

In some examples, the stored recorded operation (from block 820) may correspond only to a position rather than to a set of commands. For example, as also noted above, some implementations may include determining a current position at block 805, but not necessarily receiving further relevant commands at block 810. Correspondingly, operations at block 815, 820 may relate to the determined position but may not include recording or storing particular commands. In this regard, for example, as further discussed below, the recorded operation stored at block 820 may simply be a stored position (e.g., to which a particular actuator or other component can be commanded to return).

In some configurations, the electronic processor 700 performs the method 800 (or portions thereof) when a record mode is activated. For example, the electronic processor 700 may perform one or more of blocks 805, 810, 815, 820, or a combination thereof responsive to activation of a record mode. For instance, in some configurations, when an operator of the power machine 600 wants to record or generate a recorded operation (e.g., a new recorded operation), the operator may activate or initiate a record mode for the power machine 600. The operator may activate the record mode by interacting with the operator input device(s). For example, the operator may activate the record mode by pressing and holding a button or switch on a joystick of the power machine 600.

In some configurations, the electronic processor 700 may generate an activation alert or notification to the operator of the power machine 600. The activation alert or notification may indicate an activation status of the record mode. The activation status of the record mode may include, e.g., an active status when the record mode is active, an inactive status when the record mode is not active, etc. The activation alert may be an audible alert provided via e.g., a speaker or another type of audible output device of the power machine 600. Alternatively, or in addition, the activation alert or notification may be a visual alert provided via, e.g., a display device, an indicator (e.g., an LED indicator), or another type of visual output device of the power machine 600. Alternatively, or in addition, the activation alert may be a tactile alert.

Alternatively, or in addition, in some configurations, the electronic processor 700 performs the method 800 (or portions thereof) for a predetermined time period (e.g., a duration of time). The predetermined time period may define a period of time measured from the activation of the record mode. For example, when the predetermined time period is five seconds, the predetermined time period will expire or lapse five seconds after the record mode is activated. Correspondingly, in some configurations, the electronic processor 700 may limit recording time based on the predetermined time period. For instance, at block 815, the electronic processor 700 may record operator commands as the recorded operation received within a predetermined time period after a record mode has been instituted (e.g., within a predetermined number of seconds after an operator command indicates the start of a record mode).

Figure 9:
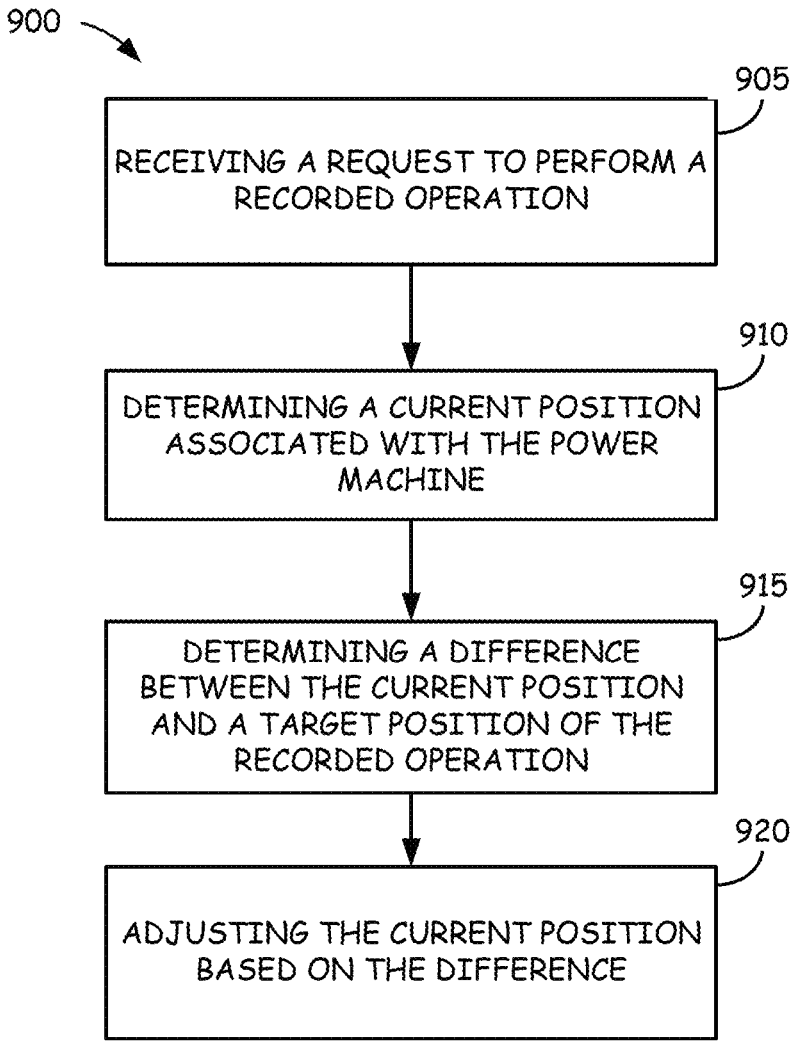
FIG. 9 is a flowchart for controlling the power machine of FIG. 6 to perform a recorded operation according to some configurations.

FIG. 9 is a flowchart illustrating a method 900 for performing a recorded operations (e.g., the recorded operation(s) 755) for a power machine (e.g., the power machine 600) according to some configurations. In some configurations, the method 900 can be performed by the control system 610 (e.g., the controller 690) and, in particular, by the electronic processor 700 of the controller 690. However, as noted above, the functionality described with respect to the method 900 may be performed by other devices or can be distributed among a plurality of devices or components (e.g., one or more electronic processors).

As illustrated in FIG. 9, the method 900 may include receiving, with the electronic processor 700, a request to perform a recorded operation (e.g., the recorded operation 755) (at block 905). As described in greater detail herein, the recorded operation 755 may include a set of operator commands for controlling the power machine 600, where the set of operator commands were provided during a previous operation of the power machine 600 (e.g., under the method 800, as discussed above) or otherwise (e.g., as pre-planned operations loaded into the power machine 600 for later execution).

In some configurations, an operator may initiate the request by performing a single press or momentary button press. In some instances, pressing the same button again may cancel performance of the recorded operation 755. As another example, in some configurations, an operator may initiate the request by performing a double button click with the joystick held out of neutral. In some cases, a recorded operation can be performed while (e.g., so long as) a joystick is held out of neutral. For example, a recorded operation can be performed in response to a button push or other input, but only so long as a joystick is held out of neutral by less than a particular percentage (e.g., 30%) of the maximum joystick stroke. In some instances, another button press or other similar input (e.g., pressing the same button again) may cancel performance of the recorded operation 755.

In some configurations, the request may identify the recorded operation 755 being requested from among a plurality of recorded operations (e.g., the recorded operations 755 stored in the database 750 of the memory 705). In some configurations, the electronic processor 700 may access the recorded operation 755 from the database 750 of the memory 705 (e.g., in response to receiving the request at block 905). For instance, in some configurations, when a recorded operation is generated (as described in greater detail herein with respect to, e.g., the method 800 of FIG. 8), the recorded operation may be associated with or assigned a specific operator input device. For example, when an operator generates a recorded operation, the operator may specify which operator input device will trigger a request to perform the recorded operation. For instance, the operator may specify a particular button or switch on a joystick of the power machine 600 such that, when the particular button or switch is interacted with, a request for that recorded operation is generated or triggered. Accordingly, in some configurations, each recorded operation 755 included in the database 750 may be associated with a particular trigger (e.g., a particular operator input device).

The electronic processor 700 may determine a current position associated with the power machine 600 (or component(s) thereof) (at block 910). With respect to block 910, the current position associated with the power machine 600 (or component(s) thereof) may refer to a current position of the power machine 600 (or component(s) thereof) when the request for performance of the recorded operation 755 is received. The electronic processor 700 may determine the current position associated with the power machine 600 (or component(s) thereof) as similarly described herein with respect to the method 800. For instance, the current position may include one or more current positions associated with the power machine 600 as a whole or one or more components of the power machine 600, including, e.g., the tractive electrical actuators 630, the workgroup electrical actuators 660, etc., as similarly described herein with respect to the method 800. The electronic processor 700 may determine the current position based at least in part on the input received from the operator input device, the sensed operation data, or a combination thereof, as similarly described herein with respect to the method 800. Accordingly, in some configurations, the electronic processor 700 may determine a current position of one or more of the electrical actuators of the power machine 600 (e.g., one or more of the tractive electrical actuators 630, the workgroup electrical actuators 660, etc.), where the one or more of the electrical actuators of the power machine 600 are associated with (or used to perform) the requested recorded operation 755.

In some cases, execution of a recorded operation can be based on position-based control. For example, the electronic processor 700 may determine a difference between the current position and a target position associated with the recorded operation (at block 915). As noted above, the target position may represent a start position of the recorded operation (e.g., the current position determined at block 805 of the method 800 of FIG. 8)—i.e., a particular position or orientation of the power machine 600 (or component(s) thereof) that the recorded operation (e.g., the set of operator commands recorded as the recorded operation) starts from. In some examples, the target position can be one of a series of target positions corresponding to movement of the power machine during the recorded operation. In some examples, the target position can be a final position (e.g., where the method 800 includes recording a target position, but not necessarily recording commands or intervening positions to reach the target position, as further discussed above).

In the various cases noted above, the determined difference may represent movement or adjustments that, when executed, will align the power machine 600 with the target position (e.g., starting, intermediate, or final position) of the recorded operation. Accordingly, in some configurations, the electronic processor 700 may determine a set of alignment commands representative of the difference between the current position and the target position, where, when the set of alignment commands are executed, the position or orientation of the power machine 600 will match or align with the position or orientation of the target position. In other examples, however, other types of control are possible. For example, as noted above, recording a power machine operation can include recording operator commands or other parameters (e.g., rather than one or more target positions). Correspondingly, operations at blocks 910, 915 can include other comparison of target and actual values to determine corresponding commands for execution of a recorded power machine operation.

Continuing, the method 900 can then generally include controlling the power machine to implement the recorded operation. For example, the electronic processor 700 may adjust the current position of the power machine 600 (or component(s) thereof) based on the position difference (at block 920) or otherwise. For instance, in some configurations, the electronic processor 700 may generate and transmit command or control signals for controlling the power machine 600 to reach or align with the target position of the recorded operation, based on a combination of proportional, derivative, or integral control relative to current and target positions of one or more actuators (or other components). Correspondingly, in some configurations, the electronic processor 700 may automatically adjust the current position of the power machine 600 based on the position difference determined at block 915. Similarly, in some instances, after adjusting the current position of the power machine 600 (or component(s) thereof), the electronic processor 700 may repeat one or more of block 910, 915 and 920 until the current position of the power machine 600 (or component(s) thereof) align with the target position (e.g., within a tolerance range).

In some configurations, the electronic processor 700 may control the power machine 600 to repeat performance of the recorded operation. For instance, the electronic processor 700 may control the power machine 600 to perform a predetermined number of repetitions of the recorded operation (e.g., a set number of repetitions). Alternatively, or in addition, in some configurations, the electronic processor 700 may control the power machine 600 to continuously perform the recorded operation 755 until operator intervention (e.g., receipt of an override command) or to perform the recorded operation 755 over a predetermined time interval.

In some configurations, the electronic processor 700 may receive, during performance of the recorded operation 755 (whether a single iteration or multiple iterations of the recorded operation 755), an override command from an operator of the power machine 600. In response to receiving the override command, the electronic processor 700 may cancel or stop performance of the recorded operation 755. Accordingly, in some configurations, the override command may be a specific stop or cancel command for cancelling the performance of the recorded operation 755 (e.g., a particular button push, etc.). Alternatively, or in addition, the override command may be a newly received operator command for controlling the power machine differently than the recorded operation. In such configurations, responsive to receiving the override command, the electronic processor 700 may cancel or stop performance of the recorded operation 755 and may control the power machine 600 in accordance with the new operator command. For example, if operations of the method 900 are raising a lift arm and an operator commands the lift arm to lower, the operator command may cause operations under the method 900 to cease and the lift arm to be lowered corresponding to the newly received operator command.

In some configurations, the electronic processor 700 may detect a fault associated with performance of the recorded operation 755. The electronic processor 700 may determine a fault when the power machine 600 does not complete an iteration or repetition of the recorded operation 755 within a predetermined time period (e.g., a duration of time) associated with an expected duration of time for performing an iteration or repetition of the recorded operation 755. For example, when performance of the requested recorded operation 755 is expected to last five seconds, the electronic processor 700 may detect a fault when the power machine 600 does not complete performance of the power machine within five seconds (e.g., or within a tolerance time range of the expected duration of the requested recorded operation 755). Thus, for example, the power machine 600 may not be caused to continue in a recorded operation if changes in loading, position, or other factors result in performance that differs from expectations.

Unless otherwise specified or limited, the terms "about" and "approximately," as used herein with respect to a reference value, refer to variations from the reference value of ±15% or less, inclusive of the endpoints of the range. Similarly, the term "substantially," as used herein with respect to a reference value, refers to variations from the reference value of ±5% or less, inclusive of the endpoints of the range.

Also as used herein in the context of power machines, unless otherwise defined or limited, "tractive" or "drive" designate actuators and other work elements of a power machine that can be powered by a power source to cause movement of the power machine over terrain (e.g., wheeled or tracked ground-engaging elements, motors configured to power ground-engaging elements, and related assemblies). In contrast, "workgroup" is used to refer to actuators or other work elements of a power machine associated with powered operation of work elements that are not configured to provide powered travel over terrain (e.g., lift arm structures, attached implements, motors or other actuators to power movement of lift arm structures or attached implements, auxiliary power take-off interfaces, and related assemblies). Thus, tractive (or drive) actuators are arranged to power travel of a power machine whereas workgroup actuators are arranged to power non-travel work operations of the power machine. Correspondingly, discussion of workgroup functions refers to one or more functions provided by movement of one or more workgroup elements of a power machine, whereas discussion of tractive (or drive) functions refer to one or more functions provided for movement of the power machine itself over terrain.

Also as used herein, unless otherwise limited or defined, "or" indicates a non-exclusive list of components or operations that can be present in any variety of combinations, rather than an exclusive list of components that can be present only as alternatives to each other. For example, a list of "A, B, or C" indicates options of: A; B; C; A and B; A and C; B and C; and A, B, and C. Correspondingly, the term "or" as used herein is intended to indicate exclusive alternatives only when preceded by terms of exclusivity, such as "either," "one of," "only one of," or "exactly one of." For example, a list of "one of A, B, or C" indicates options of: A, but not B and C; B, but not A and C; and C, but not A and B. A list preceded by "one or more" (and variations thereon) and including "or" to separate listed elements indicates options of one or more of any or all of the listed elements. For example, the phrases "one or more of A, B, or C" and "at least one of A, B, or C" indicate options of: one or more A; one or more B; one or more C; one or more A and one or more B; one or more B and one or more C; one or more A and one or more C; and one or more of A, one or more of B, and one or more of C. Similarly, a list preceded by "a plurality of" (and variations thereon) and including "or" to separate listed elements indicates options of multiple instances of any or all of the listed elements. For example, the phrases "a plurality of A, B, or C" and "two or more of A, B, or C" indicate options of: A and B; B and C; A and C; and A, B, and C.

In some embodiments, aspects of the technology disclosed herein, including computerized implementations of methods according to the technology disclosed herein, can be implemented as a system, method, apparatus, or article of manufacture using standard programming or engineering techniques to produce software, firmware, hardware, or any combination thereof to control a processor device (e.g., a serial or parallel general purpose or specialized processor chip, a single- or multi-core chip, a microprocessor, a field programmable gate array, any variety of combinations of a control unit, arithmetic logic unit, and processor register, and so on), a computer (e.g., a processor device operatively coupled to a memory), or another electronically operated controller to implement aspects detailed herein. Accordingly, for example, embodiments of the technology disclosed herein can be implemented as a set of instructions, tangibly embodied on a non-transitory computer-readable media, such that a processor device can implement the instructions based upon reading the instructions from the computer-readable media. Some embodiments of the technology disclosed herein can include (or utilize) a control device such as an automation device, a special purpose or general purpose computer including various computer hardware, software, firmware, and so on, consistent with the discussion below. As specific examples, a control device can include a processor, a microcontroller, a field-programmable gate array, a programmable logic controller, logic gates etc., and other typical components that are known in the art for implementation of appropriate functionality (e.g., memory, communication systems, power sources, user interfaces and other inputs, etc.). In some embodiments, a control device can include a centralized hub controller that receives, processes and (re) transmits control signals and other data to and from other distributed control devices (e.g., an engine controller, an implement controller, a drive controller, etc.), including as part of a hub-and-spoke architecture or otherwise.

The term "article of manufacture" as used herein is intended to encompass a computer program accessible from any computer-readable device, carrier (e.g., non-transitory signals), or media (e.g., non-transitory media). For example, computer-readable media can include but are not limited to magnetic storage devices (e.g., hard disk, floppy disk, magnetic strips, and so on), optical disks (e.g., compact disk (CD), digital versatile disk (DVD), and so on), smart cards, and flash memory devices (e.g., card, stick, and so on). Additionally, it should be appreciated that a carrier wave can be employed to carry computer-readable electronic data such as those used in transmitting and receiving electronic mail or in accessing a network such as the Internet or a local area network (LAN). Those skilled in the art will recognize that many modifications may be made to these configurations without departing from the scope or spirit of the claimed subject matter.

Certain operations of methods according to the technology disclosed herein, or of systems executing those methods, may be represented schematically in the FIGS. or otherwise discussed herein. Unless otherwise specified or limited, representation in the FIGS. of particular operations in particular spatial order may not necessarily require those operations to be executed in a particular sequence corresponding to the particular spatial order. Correspondingly, certain operations represented in the FIGS., or otherwise disclosed herein, can be executed in different orders than are expressly illustrated or described, as appropriate for particular embodiments of the technology disclosed herein. Further, in some embodiments, certain operations can be executed in parallel, including by dedicated parallel processing devices, or separate computing devices configured to interoperate as part of a large system.

As used herein in the context of computer implementation, unless otherwise specified or limited, the terms "component," "system," "module," "block," and the like are intended to encompass part or all of computer-related systems that include hardware, software, a combination of hardware and software, or software in execution. For example, a component may be, but is not limited to being, a processor device, a process being executed (or executable) by a processor device, an object, an executable, a thread of execution, a computer program, or a computer. By way of illustration, both an application running on a computer and the computer can be a component. One or more components (or system, module, and so on) may reside within a process or thread of execution, may be localized on one computer, may be distributed between two or more computers or other processor devices, or may be included within another component (or system, module, and so on).

Although the technology disclosed herein has been described with reference to preferred embodiments, workers skilled in the art will recognize that changes may be made in form and detail to the disclosed embodiments without departing from the spirit and scope of the concepts discussed herein.

What is claimed is:

1. A method to control a power machine, comprising:

receiving, with one or more electronic processors, a request to perform a recorded operation, the recorded operation corresponding to one or more of: a set of operator commands for controlling the power machine provided during previous operation of the power machine; or a position for the power machine provided during previous operation of the power machine;

determining, with the one or more electronic processors, a current position of an electrical actuator of the power machine;

determining, with the one or more electronic processors, a difference between the current position of the electrical actuator and a target position associated with the recorded operation for the electrical actuator;

adjusting, with the one or more electronic processors, the current position of the electrical actuator based on the difference;

receiving, during performance of the recorded operation, an override command from an operator of the power machine; and in response to receiving the override command:

cancelling performance of the recorded operation; and controlling the power machine in accordance with the override command, wherein the override command includes a received operator command to control the power machine differently than the recorded operation.

2. The method of claim 1, further comprising:

accessing, from a database including a plurality of recorded operations, the recorded operation and the target position of the recorded operation.

3. The method of claim 1, further comprising:

detecting activation of a record mode for the power machine; and while the record mode for the power machine is active:

determining the target position;

receiving the set of operator commands as the recorded operation; and storing the recorded operation in association with the target position, the target position being a start position for the recorded operation.

4. An electric power machine, the electric power machine comprising:

a power machine frame;

a plurality of electrical actuators supported by the power machine frame, wherein the plurality of electrical actuators includes a tractive motor, a lift actuator, and a tilt actuator;

a lift arm structure that includes:

a lift arm coupled to the power machine frame and configured to be moved relative to the power machine frame by the lift actuator; and a work element supported by the lift arm and configured to be moved relative to the lift arm by the tilt actuator;

an electrical power source configured to power the plurality of electrical actuators; and one or more electronic processors in communication with the plurality of electrical actuators, the one or more electronic processors configured to:

during activation of a record mode for the electric power machine:

determine a position associated with the plurality of electrical actuators; and receive a set of operator commands controlling the electric power machine;

store the set of operator commands as a recorded operation in association with the position as a target position, the target position being a start position to be achieved prior to performance of the recorded operation;

receive a request to perform the recorded operation;

in response to receiving the request:

control the electric power machine to achieve the target position; and control the electric power machine to automatically perform the recorded operation; and detect a fault associated with performance of the recorded operation when a length of time associated with performance of the recorded operation exceeds a predetermined time period.

5. The electric power machine of claim 4, wherein the set of operator commands includes activation of a float mode for the electric power machine.

6. The electric power machine of claim 4, wherein the set of operator commands includes an operator command that controls the tractive motor.

7. The electric power machine of claim 4, wherein the set of operator commands includes a first operator command that controls the lift actuator and a second operator command that controls the tilt actuator.

8. The electric power machine of claim 4, wherein the one or more electronic processors are further configured to:

determine a current position of at least one electrical actuator included in the plurality of electrical actuators;

determine a difference between the current position of the at least one electrical actuator and the target position; and control the electric power machine to achieve the target position based on the difference.

* * * * *